US010391337B2

(12) United States Patent
Curran et al.

(10) Patent No.: US 10,391,337 B2
(45) Date of Patent: Aug. 27, 2019

(54) RESPIRATOR ASSEMBLY WITH AIR FLOW DIRECTION CONTROL

(75) Inventors: Desmond T. Curran, Durham (GB); Andrew Murphy, Ferryhill (GB); Garry J. Walker, Stockton-on-Tees (GB)

(73) Assignee: 3M Innovative Properties Company, St. Paul, MN (US)

( * ) Notice: Subject to any disclaimer, the term of this patent is extended or adjusted under 35 U.S.C. 154(b) by 490 days.

(21) Appl. No.: 12/741,381

(22) PCT Filed: Oct. 8, 2008

(86) PCT No.: PCT/US2008/079138

§ 371 (c)(1),
(2), (4) Date: Jul. 20, 2010

(87) PCT Pub. No.: WO2009/064555

PCT Pub. Date: May 22, 2009

(65) Prior Publication Data

US 2010/0294270 A1 Nov. 25, 2010

Related U.S. Application Data

(60) Provisional application No. 60/987,145, filed on Nov. 12, 2007.

(51) Int. Cl.

| | |
|---|---|
| ***A62B 18/00*** | (2006.01) |
| ***A42B 3/28*** | (2006.01) |
| ***A62B 18/04*** | (2006.01) |

(52) U.S. Cl.

CPC ..... *A62B 18/003* (2013.01); *A42B 3/286* (2013.01); *A62B 18/045* (2013.01)

(58) Field of Classification Search

CPC ..... A62B 18/08; A62B 18/003; A62B 18/045; A62B 7/00; A62B 7/12; A62B 17/00;
(Continued)

(56) References Cited

U.S. PATENT DOCUMENTS 1,410,926 A * 3/1922 Knoblock ..... A62B 17/04 128/201.15
1,881,192 A * 10/1932 Hull ..... A62B 18/04 128/201.15

(Continued)

FOREIGN PATENT DOCUMENTS

DE 624224 8/1936
DE 3139198 C1 3/1983

(Continued)

OTHER PUBLICATIONS

Interior picture of Speedglass Helmet (applicants were in possession of the products shown in the pictures prior to the filed).

(Continued)

*Primary Examiner* — Kathryn E Ditmer

(57) ABSTRACT

A respirator assembly has a shell that defines a breathable air space for a user wearing the respirator assembly. The respirator assembly has an air delivery conduit within the shell for providing air to the breathable air space. The air delivery conduit has an air outlet that is either adjustable in configuration or has a vane associated therewith that is adjustable in position so that the direction of the air exiting the air outlet is controllable between first and second air flow directions. The user is able to control the direction of air exiting the air outlet while the respirator assembly is worn by the user.

8 Claims, 6 Drawing Sheets

(58) Field of Classification Search

CPC ..... A62B 17/006; A62B 17/04; A62B 18/00; A62B 18/006; A62B 18/02; A62B 18/025; A62B 18/04; A62B 9/02; A62B 18/10; A42B 3/286; A42B 3/24; A42B 3/28; A42B 3/281; A42B 3/283; A42B 3/288; A61F 9/06; F16K 1/16; F16K 1/18; F16K 1/20

USPC ..... 128/201.33, 201.24, 201.22, 201.23, 128/201.29, 204.18, 204.21, 201.332; 2/425, 410

See application file for complete search history.

(56) References Cited

U.S. PATENT DOCUMENTS 1,917,961 A * 7/1933 Fee ..... A62B 18/02 128/200.27
2,048,059 A 7/1936 Giraudet de Boudemange
2,882,894 A * 4/1959 Fahey ..... A62B 17/04 128/201.23
3,058,463 A * 10/1962 Goodrich, Jr. ..... A41D 13/11 128/201.23
3,223,086 A 12/1965 Denton
3,293,659 A * 12/1966 Shepard ..... A42B 3/28 128/201.15
3,327,317 A * 6/1967 Vattuone ..... A61F 9/061 2/8.3
3,413,972 A * 12/1968 Depping ..... A62B 18/045 128/201.23
3,548,415 A * 12/1970 Waters ..... A42B 3/286 165/46
3,601,219 A 8/1971 Raschke
3,636,854 A * 1/1972 Cary ..... 454/319
3,649,964 A * 3/1972 Schoelz ..... A61F 9/068 128/205.25
3,657,740 A * 4/1972 Cialone ..... A61F 9/068 128/205.25
3,683,907 A * 8/1972 Cotabish ..... A62B 18/003 128/200.28
3,735,423 A * 5/1973 Droz ..... A42C 5/04 2/171.3
3,736,927 A * 6/1973 Misaqi ..... A62B 18/003 128/201.25
3,739,774 A 6/1973 Gregory
3,777,750 A 12/1973 Savornin
3,913,468 A * 10/1975 Kramer ..... B60H 1/262 454/109
3,955,570 A 5/1976 Hutter
3,961,626 A 6/1976 Houchen
3,963,021 A 6/1976 Bancroft
4,052,984 A 10/1977 Brockway
4,055,173 A 10/1977 Knab
4,116,237 A 9/1978 Birch
4,127,130 A 11/1978 Naysmith
4,172,294 A 10/1979 Harris
4,233,972 A * 11/1980 Hauff ..... A62B 18/006 128/200.28
4,236,514 A 12/1980 Moretti
4,280,491 A 7/1981 Berg
4,403,608 A 9/1983 Warncke
4,407,280 A 10/1983 Trammell et al.
4,411,264 A 10/1983 Jacobson
4,484,575 A 11/1984 Brockway et al.
4,508,115 A 4/1985 Warncke
4,549,542 A * 10/1985 Chien ..... 128/201.24
4,571,741 A * 2/1986 Guillaumot ..... A42B 3/225 2/171.3
4,619,254 A 10/1986 Moretti et al.
4,626,122 A 12/1986 Harrison et al.
4,671,321 A 6/1987 Paetzel
4,815,458 A 3/1989 Sing
4,899,740 A 2/1990 Napolitano
4,964,178 A 10/1990 Giancarlo et al.
5,003,974 A 4/1991 Mou
5,027,807 A 7/1991 Wise et al.
5,104,430 A * 4/1992 Her-Mou ..... A62B 18/006 128/205.29
5,123,114 A 6/1992 Desanti
5,193,347 A * 3/1993 Apisdorf ..... A42B 3/285 2/171.3
5,283,914 A * 2/1994 James ..... A42B 3/16 128/201.24
5,312,298 A * 5/1994 Myers ..... F24F 13/15 454/290
H1316 H 6/1994 McGuiness
5,353,605 A * 10/1994 Naaman ..... A41D 13/0053 2/171.3
5,533,500 A * 7/1996 Her-Mou ..... A62B 18/045 128/201.24
5,577,495 A 11/1996 Murphy
5,592,936 A 1/1997 Thomas, Jr. et al.
5,690,095 A 11/1997 Glynn et al.
5,734,994 A 4/1998 Rogers
5,758,639 A 6/1998 Ikonen
5,819,728 A 10/1998 Ritchie
5,878,742 A 3/1999 Figueredo et al.
6,014,971 A 1/2000 Danisch et al.
6,032,291 A 3/2000 Asenguah et al.
6,055,666 A 5/2000 Eklund et al.
6,065,473 A * 5/2000 McCombs ..... A61M 16/0666 128/200.24
6,102,034 A 8/2000 Buhlmann
6,119,689 A * 9/2000 Korman ..... B01D 46/002 128/205.12
6,179,708 B1 * 1/2001 Yamamoto ..... B60H 1/00371 454/136
6,240,567 B1 6/2001 Johnston
6,257,235 B1 7/2001 Bowen
6,279,573 B1 8/2001 Johnson et al.
6,338,677 B1 * 1/2002 White ..... F24F 11/0001 454/256
6,374,823 B1 4/2002 Hajianpour
6,393,617 B1 5/2002 Paris
6,507,954 B1 * 1/2003 Sanchez ..... A61F 9/06 2/15
6,615,828 B1 9/2003 Petherbridge
6,619,286 B2 9/2003 Patel
6,711,748 B2 * 3/2004 Paris et al. ..... 2/171.3
6,834,646 B2 12/2004 Alon et al.
6,837,239 B2 1/2005 Beizndtsson et al.
6,973,677 B2 12/2005 Diaz et al.
7,051,732 B2 * 5/2006 Uusitalo ..... A42B 3/0433 128/201.24
7,104,264 B2 9/2006 Lee et al.
7,156,093 B2 1/2007 King
7,735,156 B2 6/2010 VanDerWoude
7,841,026 B2 * 11/2010 Makris et al. ..... 2/424
8,127,375 B2 * 3/2012 Pierce ..... 2/425
8,282,234 B2 10/2012 VanDerWoude
2003/0066121 A1 4/2003 Diaz et al.
2003/0111074 A1 6/2003 Alon et al.
2003/0135911 A1 7/2003 Wang-Lee
2003/0188743 A1 * 10/2003 Manne ..... A62B 18/003 128/201.22
2004/0002298 A1 * 1/2004 Osada ..... B60H 1/3421 454/155
2004/0003810 A1 1/2004 Templeton et al.
2004/0019958 A1 * 2/2004 Arai ..... A42B 3/283 2/424
2004/0055601 A1 3/2004 De Luca et al.
2004/0144382 A1 7/2004 Alvey et al.
2004/0187195 A1 * 9/2004 Wang Lee ..... A42B 3/281 2/410
2004/0188743 A1 9/2004 Li et al.
2004/0200089 A1 * 10/2004 Melendrez ..... A47K 10/48 34/90
2005/0010992 A1 1/2005 Klotz et al.
2005/0022817 A1 2/2005 Alvey
2005/0061317 A1 3/2005 King
2005/0199235 A1 9/2005 Borsari
2006/0048777 A1 3/2006 Brookman

(56) References Cited

U.S. PATENT DOCUMENTS

| | | | | |
|---|---|---|---|---|
| 2006/0048782 | A1 | 3/2006 | Gossweiler | |
| 2006/0073781 | A1* | 4/2006 | Mochizuki | B60H 1/3421 454/152 |
| 2006/0101557 | A1* | 5/2006 | Klotz | A41D 13/1153 2/171.3 |
| 2006/0137686 | A1 | 6/2006 | Macris | |
| 2006/0172679 | A1* | 8/2006 | Gehring | B60H 1/3421 454/152 |
| 2007/0137712 | A1* | 6/2007 | Gossweiler | A62B 18/006 137/494 |
| 2007/0283961 | A1* | 12/2007 | Hsieh | 128/205.29 |
| 2008/0202509 | A1* | 8/2008 | Dillon | A41D 13/1153 128/201.25 |
| 2009/0055987 | A1* | 3/2009 | Becker et al. | 2/8.6 |
| 2009/0089908 | A1* | 4/2009 | Huh | 2/8.6 |
| 2010/0108067 | A1 | 5/2010 | Walker | |
| 2011/0265790 | A1 | 11/2011 | Walker | |

FOREIGN PATENT DOCUMENTS

| | | | | | |
|---|---|---|---|---|---|
| DE | 3316920 | C1 | * | 11/1984 | A42B 3/24 |
| EP | 0027521 | A1 | * | 4/1981 | A62B 18/04 |
| EP | 027521 | B1 | | 7/1983 | |
| EP | 0325959 | A2 | | 8/1989 | |
| EP | 0 602 847 | | | 12/1993 | |
| EP | 0528733 | B1 | | 9/1996 | |
| EP | 127941 | | | 1/2003 | |
| FR | 1102541 | | | 10/1955 | |
| GB | 238819 | A | * | 8/1925 | F23L 13/00 |
| GB | 2160108 | A | | 12/1985 | |
| GB | 2338400 | A | | 12/1999 | |
| JP | 18001830 | | | 2/1943 | |
| JP | 47-035838 | | | 9/1972 | |
| JP | 48-019998 | | | 6/1973 | |
| JP | 53-159197 | | | 5/1977 | |
| JP | 59-030250 | | | 2/1984 | |
| JP | 59-41435 | | | 3/1984 | |
| JP | 61-122449 | | | 6/1986 | |
| JP | 63-131726 | | | 8/1988 | |
| JP | 63-180058 | | | 11/1988 | |
| JP | 63-189266 | | | 12/1988 | |
| JP | 4-65556 | U | | 10/1990 | |
| JP | 09-236300 | | | 9/1997 | |
| JP | 11-208261 | | | 8/1999 | |
| JP | 11-290472 | | | 10/1999 | |
| JP | 2001-170649 | | | 6/2001 | |
| JP | 2002-348720 | | | 12/2002 | |
| JP | 2003-49317 | | | 2/2003 | |
| JP | 2003-119611 | | | 4/2003 | |
| JP | 2003-336120 | | | 11/2003 | |
| JP | 2004-156151 | | | 6/2004 | |
| JP | 2004-270087 | | | 9/2004 | |
| JP | 2006 009181 | | | 1/2006 | |
| JP | 2006009181 | | | 1/2006 | |
| JP | 43-52448 | | | 8/2009 | |
| JP | 45-14909 | | | 5/2010 | |
| KR | 2002-0011308 | | | 2/2002 | |
| KR | 20-0415425 | | | 5/2006 | |
| KR | 20-0415988 | | | 5/2006 | |
| WO | WO 94/03235 | | | 2/1994 | |
| WO | WO 96/40370 | | | 12/1996 | |
| WO | WO 02/13884 | | | 11/1997 | |
| WO | WO 99/24742 | | | 11/1997 | |
| WO | WO 98/54991 | | | 12/1998 | |
| WO | WO 01/44126 | | | 12/2000 | |
| WO | WO 01/52675 | A2 | | 7/2001 | |
| WO | WO 2006/006819 | | | 1/2006 | |
| WO | WO 2006/102545 | A2 | | 9/2006 | |
| WO | WO 2007/011646 | | | 1/2007 | |
| WO | WO 2007/028877 | A2 | | 3/2007 | |
| WO | WO 2007028877 | A2 | * | 3/2007 | A61M 16/0683 |
| WO | WO-2007028877 | A2 | * | 3/2007 | A61M 16/0683 |
| WO | WO 2008/118770 | A1 | | 10/2008 | |

OTHER PUBLICATIONS

Picture of Albatross Helmet (applicants were in possession of the products shown in the pictures prior to the filing date).

Interior picture of Optrel Helmet (applicants were in possession of the products shown in the pictures prior to the filing date).

Solar-Powered Cooling Pith Helmet from Hammacher Schlemmer, obtained from internet on Jan. 22, 2007, http://www.hammacher.com/publish/72808.asp?source=google.

* cited by examiner

RESPIRATOR ASSEMBLY WITH AIR FLOW DIRECTION CONTROL

CROSS REFERENCE TO RELATED APPLICATIONS

This application is a national stage filing under 35 U.S.C. 371 of PCT/US2008/079138, filed Oct. 8, 2008, which claims priority to U.S. Provisional Application No. 60/987,145, filed Nov. 12, 2007, the disclosure of which is incorporated by reference in its/their entirety herein.

BACKGROUND

Generally, this disclosure relates to respirator assemblies that are worn on a user's head to provide breathable air for the user.

Respirators are well known and have many uses. For example, certain types of respirators may be used to aid the users' breathing in a contaminated atmosphere, such as a smoke filled atmosphere, a fire or a dust laden atmosphere, a mine, a toxic atmosphere, or a laboratory. Respirators may also be worn where it is desired to protect the user from contaminating the surrounding atmosphere, such as when working in a clean room used to manufacture silicone chips.

Some respirators include a hard shell portion that is intended to provide at least some protection against impacts, when working in a dangerous environment or when the user is at risk of being struck by falling or thrown debris such as in a mine, an industrial setting, or on a construction site. Another type of respirator employs a soft shell when head protection from impact is not believed to be required such as, for example, when working in a laboratory or a clean room.

A respirator hood is usually made of a soft, flexible material suitable for the environment in which the hood is to be worn, and an apron or skirt may be provided at a lower end of the hood to extend over the shoulder region of the user. Hoods of this type are sometimes used with a bodysuit to isolate the user from the environment in which the user is working. The apron or skirt often serves as an interface with the bodysuit to shield the user from ambient atmospheric conditions. A respirator head cover does not cover a user's entire head, but typically only extends above the ears of the user and down about the chin of the user in front of the user's ears. The hood or head cover has a transparent region at the front, commonly referred to as a visor, through which the user can see. The visor may be an integral part of the hood or head cover or it may be detachable so that it can be removed and replaced if damaged.

A respirator hard shell portion is usually made from a hard, inflexible material suitable for the environment in which the respirator is to be worn. For example, such materials may include metallic materials, such as steel, or hard polymers. A respirator hard shell portion typically will extend at least over the top of the user's head, and may have a brim around all sides thereof, or a bill extending forwardly therefrom, thereby providing additional protection over the user's facial area. In addition, such a respirator may also include protective sides extending downwardly from along the rear and sides of the user's head. Such sides may be formed from an inflexible material or may be formed from a flexible material. A respirator assembly having a hard shell portion may also include a visor that permits the user to see outside of the respirator. The visor may be transparent. However, in some instance, such as for welding, the visor may be tinted or it may include a filter or shutter, such as an auto darkening fitter (ADF). The visor may be an integral part of the respirator assembly or it may be detachable so that is can be removed and replaced if damaged.

A respirator shell is intended to provide a zone of breathable air space for a user. As such, the shell is also typically sealed about the user's head and/or neck area. At least one air supply provides breathable air to the interior of the respirator. The air supply pipe may be connected to a remote air source separate from the user, but for many applications, the air supply pipe is connected to a portable air source carried by the user, for example, in a backpack or on a belt. In one form, a portable air supply comprises a turbo unit, including a fan driven by a motor powered by a battery and a filter. The portable air supply is intended to provide a breathable air supply to the user for a predetermined period of time.

Air may be distributed within a respirator from one or more outlets. However, the user of a typical respirator may be unable to control the direction of air flow from the outlet(s). What one person perceives as a pleasant breeze, another person may consider to be a cold draft. In some cases a particular distribution of air flow may actually cause user discomfort, such as, for example, the drying of a user's eyes.

SUMMARY

A respirator assembly comprises a protective shell shaped to cover at least a portion of a user's head, an outlet for delivering a flow of air into a space defined between the shell and the user's head, and a vane at the outlet that is adjustable between a first position wherein the air flow from the outlet is directed in a first direction and a second position wherein the air flow from the outlet is directed in a second, different direction.

In another aspect, a respirator assembly comprises a protective shell shaped to cover at least a portion of a user's head, and an outlet for delivering a flow of air into a space defined between the shell and the user's head, wherein the outlet is adjustable between a first outlet configuration wherein the air flow from the outlet is directed in a first direction and a second outlet configuration wherein the air flow from the outlet is directed in a second, different direction.

This summary is provided to introduce a selection of concepts in a simplified form that are further described below in the Detailed Description. This summary is not intended to identify key features or essential features of the claimed subject matter, is not intended to describe each disclosed embodiment or every implementation of the claimed subject matter, and is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure is referred to by like reference numerals throughout the several views.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art which fall within the scope and spirit of the principles of this disclosure.

DETAILED DESCRIPTION

Glossary

The terms set forth below will have the meanings as defined:

The terms hoods and head covers are used to refer to loose fitting face pieces that cover at least a face of the user.

The terms helmet, hard hat and bump cap are used to refer to head coverings that are intended to provide varying degrees of impact protection to a user's head, with a helmet providing the highest degree of protection and a bump cap—the lowest.

Non-shape stable means a characteristic of a structure whereby that structure may assume a shape, but is not necessarily able, by itself, to retain that shape without additional support.

Shape stable means a characteristic of a structure whereby that structure has a defined shape and is able to retain that shape by itself, although it may be flexible.

Breathable air space means the space around at least a user's nose and mouth where air may be inhaled.

Protective shell means a barrier that separates an interior of a respirator assembly, including at least the breathable air space, from the ambient environment of the respirator assembly.

Manifold means an air flow plenum having an air inlet and having one or more discrete air conduits in communication with the air inlet, with each air conduit having at least one air outlet.

Vane means a moveable structure disposed adjacent an air flow outlet that determines the flow direction of air exiting the outlet, dependent upon the position of the structure relative to the outlet.

Controller means a device or system that is used to adjust the position of the vane relative to its respective air flow outlet.

Figure 1:
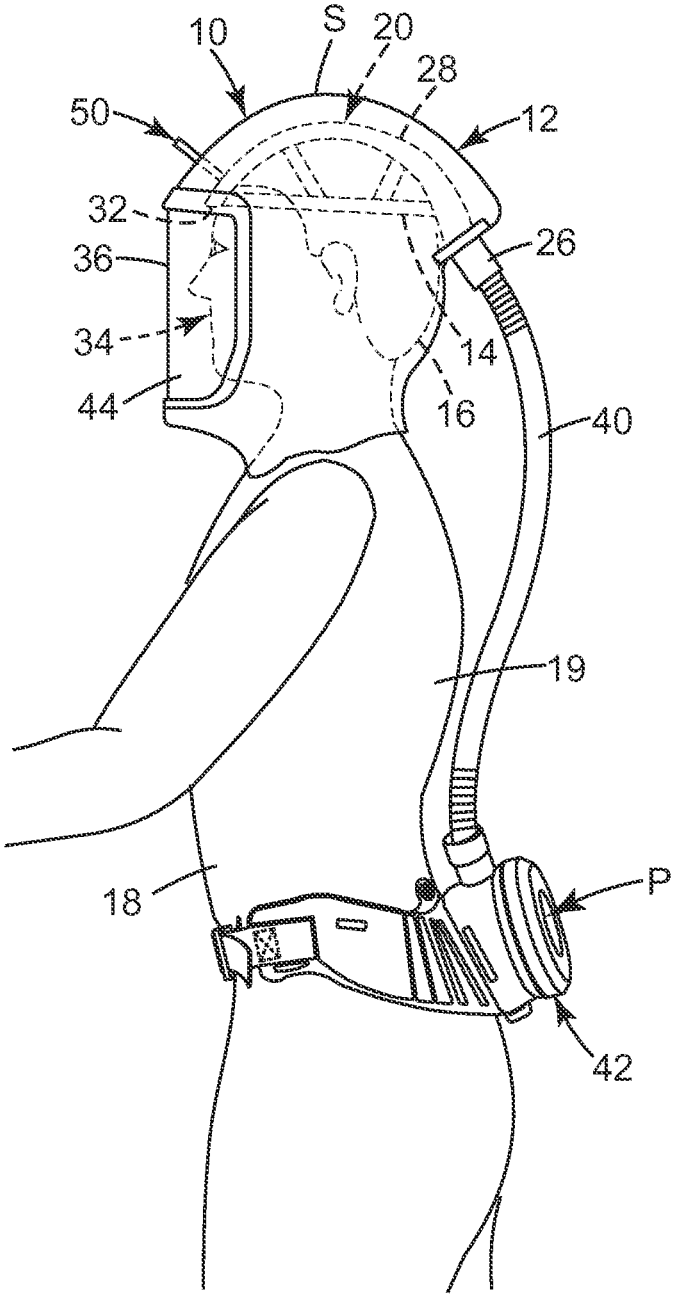
FIG. 1 is a side elevation of a respirator assembly having a respirator hood for covering the head of a user.

An exemplary respirator assembly 10 is illustrated in FIG. 1. In this instance, the respirator assembly 10 includes a hood 12 that serves as a protective shell S for the respirator assembly 10. Respirator assembly 10 further includes a head harness 14 that is adjustable in one or more dimensions so that it may be sized to conform to a head 16 of a user 18. The hood 12 is sized to extend over at least the front and top of the head 16 of the user 18, if not over the entire head 16. The hood 12 illustrated in FIG. 1 entirely covers the head 16 of the user 18, and may be used in combination with a full protective body suit 19 worn by the user 18. The respirator assembly may have alternative configurations, such as those including head covers that cover only a top and front portion of the head of a user (leaving the user's ears, neck and shoulders uncovered). In some exemplary embodiments, a protective shell may be non-shape stable and incorporate a shape stable air manifold 20.

The air manifold 20 is supported by the head harness 14, and may be removably connected thereto. When connected and mounted on a user's head 16 as illustrated in FIG. 1, the head harness 14 supports the air manifold 20 in a desired position relative to the user's head 16.

The air manifold 20 has an air inlet conduit 26 and at least one air delivery conduit 28. In one embodiment, the air inlet conduit 26 is disposed adjacent the back of the user's head 16 and extends out of the protective shell S. The air inlet conduit 26 is in fluid communication with the air delivery conduit 28, and the air delivery conduit has an air outlet 32. In one embodiment, the air outlet 32 is adjacent a facial area 34 of the head 16 of the user 18. While one air delivery conduit 28 is illustrated on the manifold 20 in FIG. 1, it is understood that any number (e.g. one, two, three, etc.) of such conduits may be provided, with each conduit having a respective air outlet. Further, in some embodiments, a manifold may have one or more outlets of respective air delivery conduits adjacent a user's forehead, and one or more outlets of respective air delivery conduits adjacent a user's nose and mouth (e.g., on each side of the user's nose and mouth). The protective shell S includes a visor 36 disposed on a front side thereof through which a user can see. The air inlet conduit 26 of the manifold 20 is in fluid communication with a supply of breathable via an air hose 40 that is in turn connected to a supply 42 of breathable air for the user 18. Such a supply 42 might take the form of a pressurized tank of breathable air, a powered air-purifying respirator (PAPR) or another supplied breathable air source, as may be desired for a particular application. In the embodiment illustrated in FIG. 1, the manifold 20 is coupled to a PAPR air and/or power supply P that is carried on a belt worn by the user 18. Air flows from the air supply 42 through hose 40 and into air inlet conduit 26 of the manifold 20. The air then flows through each air delivery conduit 28 of the manifold 20 and out of each conduit 28 from its air outlet 32 and into a breathable air space 44 defined by the protective shell S about the head 16 of the user 18. Breathable air is thus delivered by the manifold 20 to the user's facial area 34 for inhalation purposes which, in some embodiments, includes not only the space around the user's nose where air may be inhaled, but also other areas about the user's face such as around the user's eyes and forehead.

Because of the introduction of such air, the air pressure within the protective shell S typically may be slightly greater than the air pressure outside the shell. Thus, in some exemplary embodiments, a hood can expand generally to the shape illustrated in FIG. 1 about the user's head 16, air manifold 20 and head harness 14. As is typical, air is allowed to escape the protective shell S via exhalation ports (not shown) or via allowed leakage adjacent lower edges of the protective shell S (e.g., about the neck and/or shoulders of the user 18) or, in some exemplary embodiments, through the protective shell S. The respirator assembly 10 thus may provide the user with a breathable air space 44 within a non-shape stable protective shell S with the air delivered adjacent the user's face by the shape stable manifold 20. However, in other exemplary embodiments, either one or both of the protective shell S and the manifold 20, or any portions thereof, may be shape stable or non-shape stable.

The position of the manifold 20 with respect to the user's head is fixed relative to the user by its mounting on the head harness 14. Thus, the position of the air outlet 32 of the manifold 20 is fixed in position relative to the user (and more particularly, relative to the user's facial area 34). The direction of air flow out of the air outlet 32 via the respirator assembly 10 may be controlled by a vane that is disposed adjacent the air outlet 32 and that is adjustable to define different air flow exit paths out of the air outlet 32.

Figure 2:
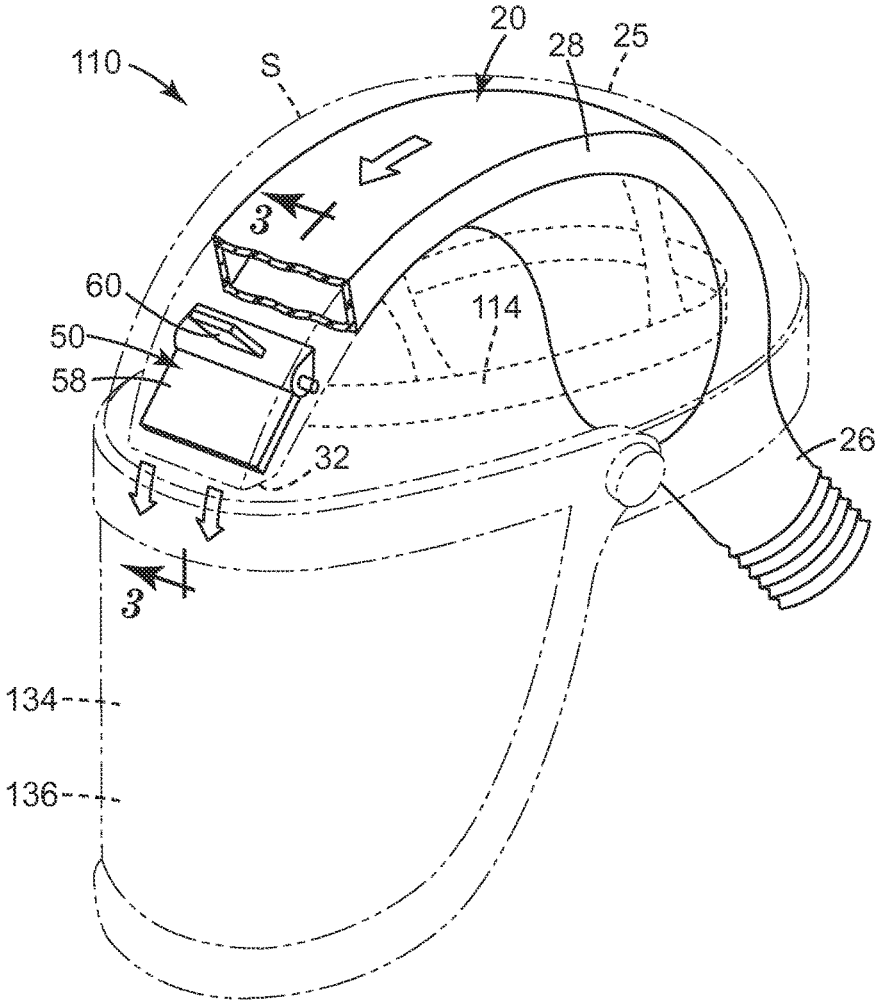
FIG. 2 is a perspective view of an embodiment of the respirator assembly having a hard shell helmet for covering the head of a user.

FIG. 2 illustrates an exemplary respirator assembly 110 having a hard hat 25 used in combination with the manifold 20. The protective shell S of the exemplary respirator assembly 110 has a shape stable configuration and that may be (at least in part) impact-resistant to some degree. FIG. 2 illustrates a hard hat 25 that is sized to cover only the top of the user's head along with the facial area thereof. Alternative hard hat styles include those that cover a user's entire head. A head harness (such as the exemplary head harness 114 shown in FIG. 2) is provided to fit the respirator assembly 110 to the head of a user, and to support and position the hard hat and manifold thereon. The head harness 114 may be removable from the hard hat and/or manifold. The hard hat 25 includes a visor 136 disposed on a front side thereof through which a user can see. The hard hat 25 may be sealed about the head and/or neck of the user so that within its protective shell S, a breathable air space 134 is defined. Air is provided via the air inlet 26 into the air delivery conduit 28 of the manifold 20, and exits therefrom into breathable air space 134 via the air outlet 32 on the conduit 28. Exhalation ports (not shown) or controlled air leakage around the seal defined adjacent a lower portion of the hard hat 25, or in any other way suitable for a particular application, may be provided to cycle air through the breathable air space.

Figure 3:
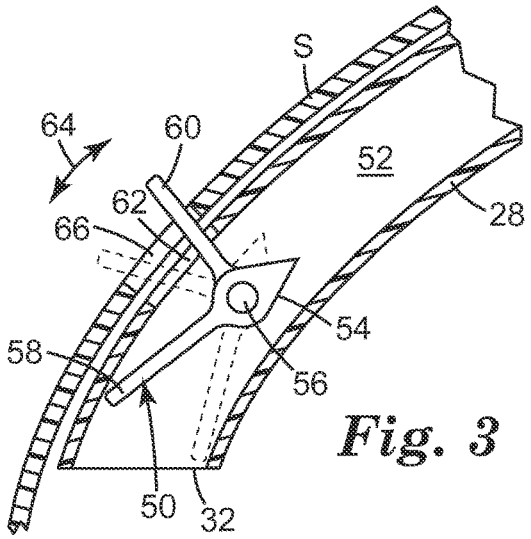
FIG. 3 is a partial sectional view as taken along lines 3-3 in FIG. 2.

FIGS. 1, 2, and 3 illustrate an exemplary vane structure for controlling the direction of air flow out of the air outlet 32 of the air delivery conduit 28. A vane 50 extends across an air flow channel 52 within the conduit 28 and is pivotally mounted therein. The vane 50 has a hub 54 which includes or receives a spindle 56 that is pivotally received within the walls of the conduit 28. A vane panel 58 is attached to the hub 54 and extends across and along the channel 52 adjacent the air outlet 32. A vane actuator paddle or controller 60 projects from the hub 54 in a different direction than the vane panel 58. In the illustrated embodiment, the paddle 60 extends generally perpendicular to the vane panel 58, although other angular orientations may be desired. The paddle 60 extends through a slot 62 in a top wall of the conduit 28 to permit pivoting movement of the paddle 60 relative to the conduit 28, such as illustrated for example by the solid and phantom lines in FIG. 3. The pivoting movement of the paddle 60 may follow the arrows 64 in FIG. 3. Movement of the paddle 60 causes movement of the vane panel 58. Depending upon the position of the vane panel 58 relative to the channel 52, the direction of air flow exiting the air outlet 32 is changed so that the air flow from the air outlet 32 may be directed in a first direction or in a second, different direction.

The slot 62 in the conduit 28 may include a gasket to limit air flow through the slot 62 while permitting pivotal movement of the paddle 60 within the slot 62. The paddle 60 also may extend through a slot 66 in the protective shell S. In this instance, the slot 66 may also include a gasket to limit possible air flow through the slot 66, while permitting movement of the paddle 60 within the slot 66.

The vane 50 is accessible by a user while the respirator assembly is worn by that user to control the direction of air flow exiting the air outlet 32 of the conduit 28. A user can manipulate the paddle 60 to change the direction of air flow from one direction to another without having to remove the respirator assembly, or without having to pre-adjust the direction of air flow prior to mounting of the respirator assembly onto the user's head. In the instance where the shell S is formed from a non-shape stable material, such as a fabric, it may be possible simply to grasp the paddle 60 through the flexible material and manipulate it, so that no opening or slot is necessary in the shell S for permitting operable access by a user to the paddle 60.

Each individual user can thus control the air flow within the respirator assembly to obtain what that user considers to be a comfortable environment within the breathable air space. By being able to adjust the direction of air flow exiting the air outlet, the user is able to change the perceived cooling effect of that air flow, and also is able to adjust the air flow to minimize any possible discomfort that could be caused by a particular directionality of the air flow.

Figure 4:
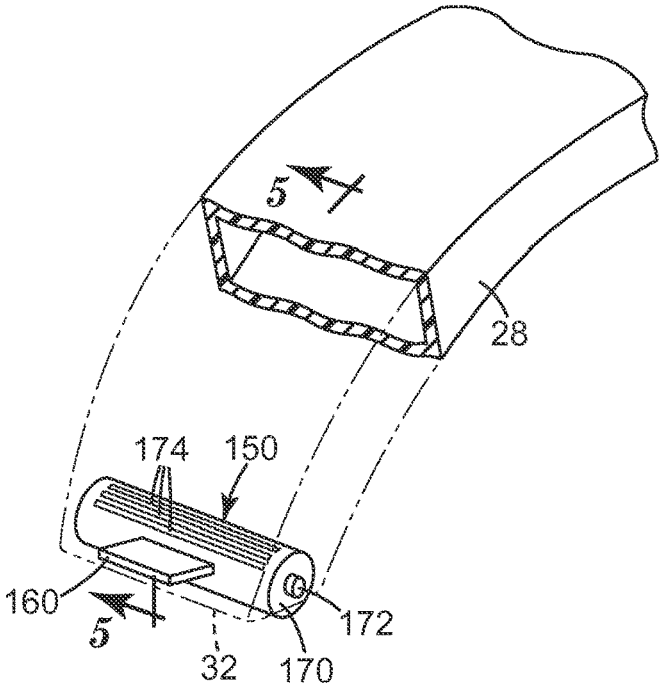
FIG. 4 is a perspective view of a portion of an air flow manifold for use in the respiratory assembly, and illustrating an alternative embodiment of a vane structure at an outlet of the air flow manifold.
Figure 5:
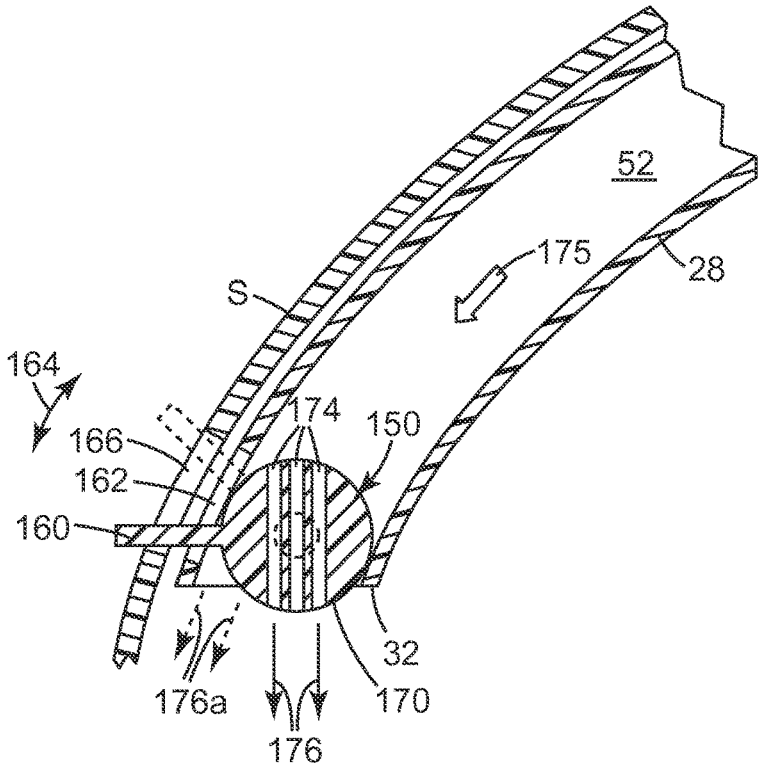
FIG. 5 is a partial sectional view as taken along lines 5-5 in FIG. 4, with a shell of a hood or helmet structure also shown in section.

FIGS. 4 and 5 illustrate an alternative configuration for a vane 150 of a respirator assembly. In this arrangement, the vane 150 extends across the air outlet 32 in the form of a body 170. The body 170, which may be cylindrical in shape, is pivotally mounted at its ends via spindles 172 relative to and within the conduit 28 and thus extends across the channel 52 thereof. A plurality of vane channels 174 extend through the body 170, and provide the only path available for air flowing through the channel 52 (arrow 175) to exit the air outlet 32 (such as illustrated by air flow arrow 176). A paddle or controller 160 extends outwardly from the body 170 for use in manipulating the position of the vane channels 174. Like the paddle 60 of the vane 50 illustrated in FIG. 3, the paddle 160 of the vane 150 of FIGS. 4 and 5 extends through associated slots 162 and 166 in the conduit 28 and shell S, respectively. The slots 162 and 166 may have associated gaskets for air flow sealing purposes, as noted above. The paddle 160 is thus movable relative to the manifold 28 in the direction of arrows 164, as illustrated in FIG. 5. When the paddle 160 is pivoted to the position illustrated in phantom in FIG. 5, the vane channels 174 have likewise been pivoted and the air flow direction exiting the air outlet 32 is thus generally as illustrated by arrows 176*a* in FIG. 5. The paddle 160 may be manipulated by a user wearing the respirator assembly. Thus, the vane 150 illustrated in FIGS. 4 and 5 provides an alternative arrangement for controlling the direction of air flow into the breathable air space in a respirator assembly while a user is wearing the respirator assembly.

Figure 6:
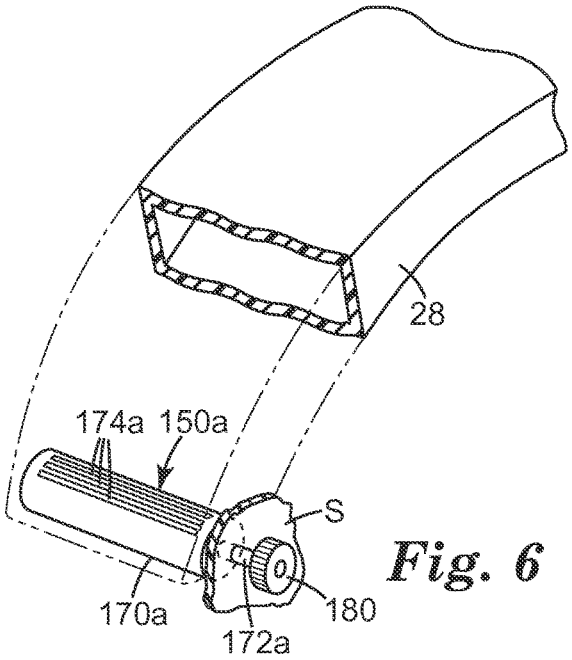
FIG. 6 is a partial perspective view of an alternative embodiment of the vane structure of FIG. 4.

FIG. 6 illustrates an alternative means for adjusting the orientation of a vane 150*a* which is similar to the vane 150 of FIGS. 4 and 5. In this arrangement, no paddle 160 is provided on the vane 150*a*. Rather, a knob or controller 180 is connected to a spindle 172*a* which is in turn connected to an end of a body 170*a* of the vane 150*a*. The knob 180 (which may take the form of a cylindrical knob, or a lever or some other user-grippable and/or manipulatable handle) is rotated about the axis of the spindle 172*a* to pivot the body 170*a* relative to and within the conduit 28. Thus, the orientation of a plurality of vane channels 174*a* on the vane 150*a* can be adjusted by a user while wearing the respirator assembly. The knob 180 is accessible by the user while the respirator assembly is worn, such as extending outside of the shell S of the respirator assembly, as illustrated in FIG. 6.

The extent of pivoting movement of the vane (whether the vane has a structure such as the vane 50, the vane 150, or the vane 150*a*), may be limited in some regard. For instance, the size of the slot in the manifold 28 may limit the extent of movement of the vane 50 or the vane 150. Alternatively, one or more fins with protrusions on the manifold 28 or the vane itself may limit the extent of its pivoting movement. Elements may also be provided to provide a tactile indication (or even an audible "click" indication) to a user that the vane has been placed in its first or second position for air flow direction control. While there are only two vane positions that have been mentioned, the vane may be positioned in any number of angular orientations relative to the air outlet 32, within its range of allowed pivoting.

Figure 7:
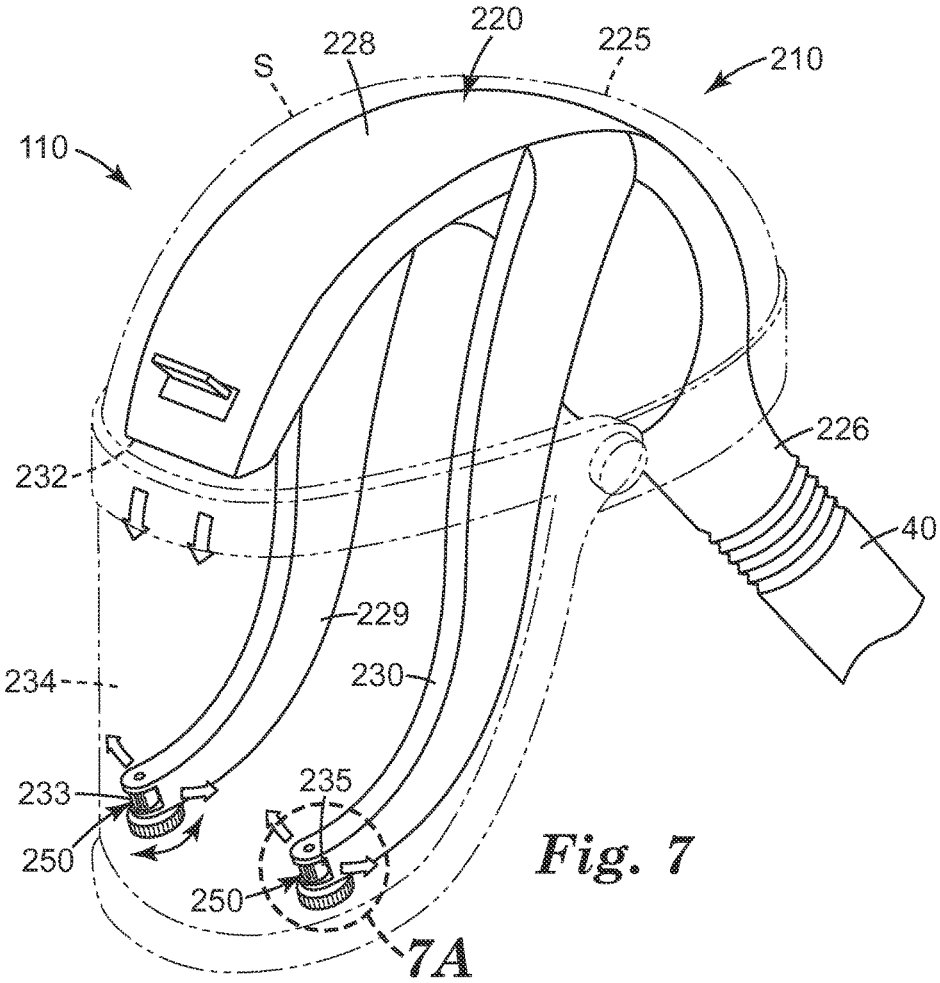
FIG. 7 is a perspective view of an alternative embodiment of a respirator assembly having, for example, a hard shell helmet.

FIG. 7 illustrates an alternative respirator assembly 210 wherein a manifold 220 has a plurality of air delivery conduits such as air delivery conduits 228, 229 and 230. The air delivery conduits 228, 229 and 230 are all in fluid communication with an air inlet conduit 226 which is in fluid communication with an air hose 40 for delivering a supply of breathable air to the respirator assembly 210. FIG. 7 illustrates the respirator assembly having a hard hat 225 for defining the protective shell S, but any other type of a respirator assembly may be used, such as those including a bump cap, helmet, hood or a head cover.

Each air delivery conduit 228, 229 and 230 has an air outlet 232, 233 and 235, respectively for delivering air to a breathable air space 234 within the shell S. A vane is provided adjacent the air outlet 232 of the air conduit 228, in order to control the direction of air flow exiting the outlet 232. The vane may be controlled by the user while the respirator assembly is worn by the user, and may take the form of one of the vanes described above or a functional equivalent thereof.

Figure 7A:
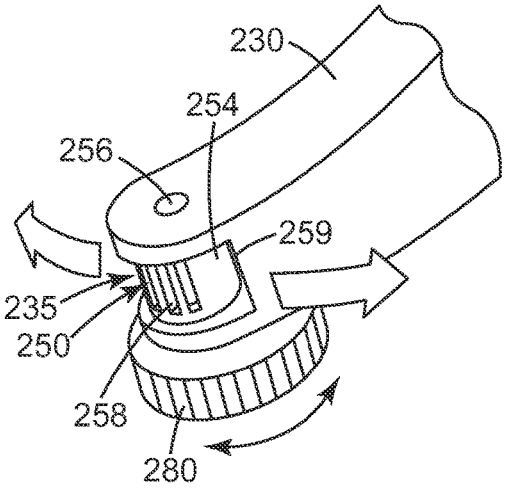
FIG. 7A is an enlarged perspective view of section 7A of FIG. 7.

The air delivery conduits 229 and 230 extend down each side of the respirator assembly and may have their respective air outlets 233 and 235 adjacent a user's mouth and/or nose area, on each side thereof. Each air outlet has a vane associated therewith in order to control the direction of air flow exiting that air outlet, with each vane is operable by the user while the respirator assembly is worn by that user. For instance, as shown in FIG. 7A, air outlet 235 includes a vane 250 that has a hub 254 which includes or receives a spindle 256 that is pivotally received within the walls of the conduit 230. One or more channels 258 extend through the hub 254, wherein the hub 254 extends across and along a channel 259 within the conduit 230 adjacent the air outlet 235. A knob or controller 280 or other suitable user-manipulatable member is connected to the spindle 256 so that rotation of the knob 280 causes pivoting of the vane channel 258 relative to the air outlet 235. Pivoting of the vane channel 258 thereby controls the direction of air flow exiting the air outlet 235. The knob 280 is either accessible outside of the shell S of the respirator assembly, or is manipulatable through the shell S by the user, while wearing the respirator assembly. A vane 250 may also be provided for the air outlet 233 on the conduit 229. Thus, the respirator assembly illustrated in FIGS. 7 and 7A illustrates a manifold wherein the delivery of air flow into the breathable air space can be split between an area adjacent the user's forehead and the user's mouth or nasal area. At each of one or more of the outlets where air is delivered into the breathable air space, a vane may be provided to allow the user discrete control over the direction of air flow exiting each air delivery conduit of the manifold (while wearing the respiratory assembly).

Figure 8:
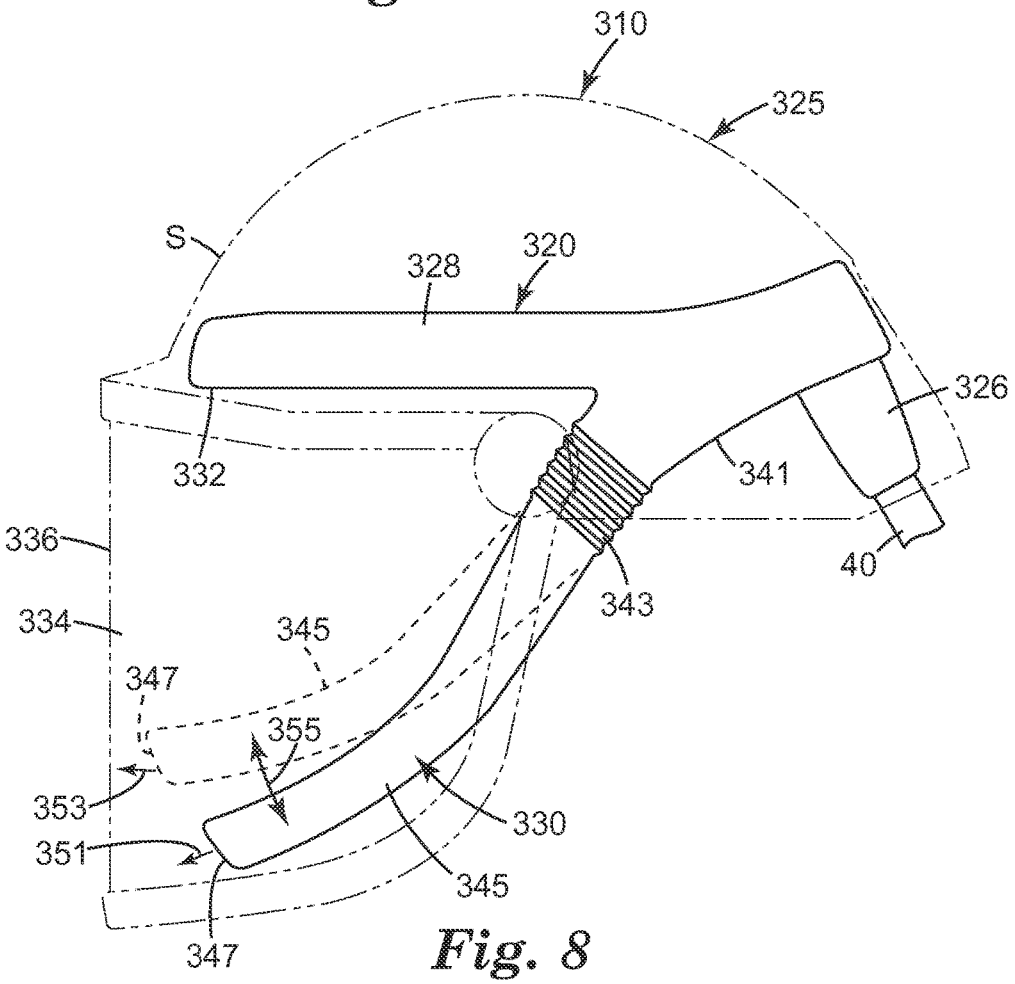
FIG. 8 is a side view of an alternative embodiment of a respirator assembly having, for example, a hard shell helmet.

FIG. 8 illustrates an alternative respirator assembly 310 wherein a manifold 320 has a plurality of air delivery conduits 328 and 330. The air delivery conduits 328 and 330 are all in fluid communication with an air inlet conduit 326 which is in fluid communication with an air hose 40 for delivering a supply of breathable air to the respirator assembly 310. FIG. 8 is a side view, and illustrates only a top conduit 328 and one side conduit 330 (on a left side of the respirator assembly 310). In one embodiment, another side conduit is provided on the right side of the respirator assembly 310. The air delivery conduit 328 has, adjacent the forehead area of the user, an air outlet 332 for delivering air to a breathable air space 334 defined within the shell S formed by the respirator assembly 310. As illustrated in FIG. 8, the shell S is defined by a hard hat 325, but any other type of a respirator assembly may be used, such as those including a bump cap, helmet, hood or a head cover. As discussed above, a vane may be provided adjacent the air outlet 332 to control the direction of air flow exiting the outlet 332 adjacent a user's forehead, at the discretion of a user and while the respirator assembly 310 is worn by the user.

The air delivery conduit 330 has an upper portion 341 where it is in fluid communication with the air delivery conduit 328, an elbow portion 343 and a lower portion 345. An air outlet 347 is disposed at a distal end of the lower portion 345 of the air delivery conduit 330. The position of the air outlet 347 on the lower portion 345 is adjustable between a first outlet configuration wherein the air flow from the outlet is directed in a first direction and a second outlet configuration wherein the air flow from the outlet is directed in a second, different direction. The lower portion 345 is movable relative to the upper portion 341 by manipulation of the elbow portion 343. The elbow portion 343 is flexible and allows movement of the lower portion 345 relative to the upper portion 341. This would enable movement of the lower portion 345 of the delivery conduit 330 with a visor 336 of the respirator assembly 310. The elbow portion 343 has sufficient rigidity retention that once moved, it holds the lower portion 345 in the desired position relative to the upper portion 341. For instance, FIG. 8 illustrates the lower portion 345 in a first lower position in solid lines, and in a second upper position in phantom. In the lower position, air flow exiting the air outlet 347 travels generally in direction of arrow 351, while in the upper position, air flow exiting the air outlet 347 travels generally in direction of arrow 353. The air outlet 347 is thus movable along with the lower portion 345 generally in direction of the arrow 355 in FIG. 8.

In the illustrated embodiment, the air outlet 347 is adjacent a user's nose and mouth, and adjacent the visor 336 on a front portion of the respirator assembly 310. Movement of the lower portion 345 of the air delivery conduit 330 can be performed by a user while wearing the respirator assembly 310, either by linking the lower portion 345 to a manipulatable element outside of the shell S, or by forming the material of the shell S adjacent the lower portion 345 of material through which a user can manipulate the position of the lower portion 345. Thus, the respirator assembly 310 illustrated in FIG. 8 illustrates an alternative arrangement for controlling the direction of air flow into the breathable air space in the respirator assembly while the user is wearing the respirator assembly.

Although the respirator assemblies disclosed herein have been described with respect to several embodiments, workers skilled in the art will recognize that changes may be made in form and detail without departing from the spirit and scope of the respirator assembly disclosure. For instance, the vanes illustrated are intended to be exemplary only, and other vane shapes are contemplated. Any suitable shape for the vane structure will be sufficient so long as it is capable of controlling the direction of air flow exiting the air outlet of its respective air delivery conduit of the manifold. In respirator assemblies where the shell includes a non-shape stable portion, the non-shape stable portion may be formed from, for example, such materials as fabrics, papers, polymers (e.g., woven materials, non-woven materials, spunbond materials (e.g., polypropylenes or polyethylenes) or knitted substrates coated with polyurethane or PVC) or combinations thereof. In exemplary embodiments including a hard shell portion, the hard shell portion may be formed from, for example, such materials as polymers (e.g., ABS, nylon, polycarbonates or polyamides or blends thereof), carbon fibers in a suitable resin, glass fibers in a suitable resin or combinations thereof.

Figure 9:
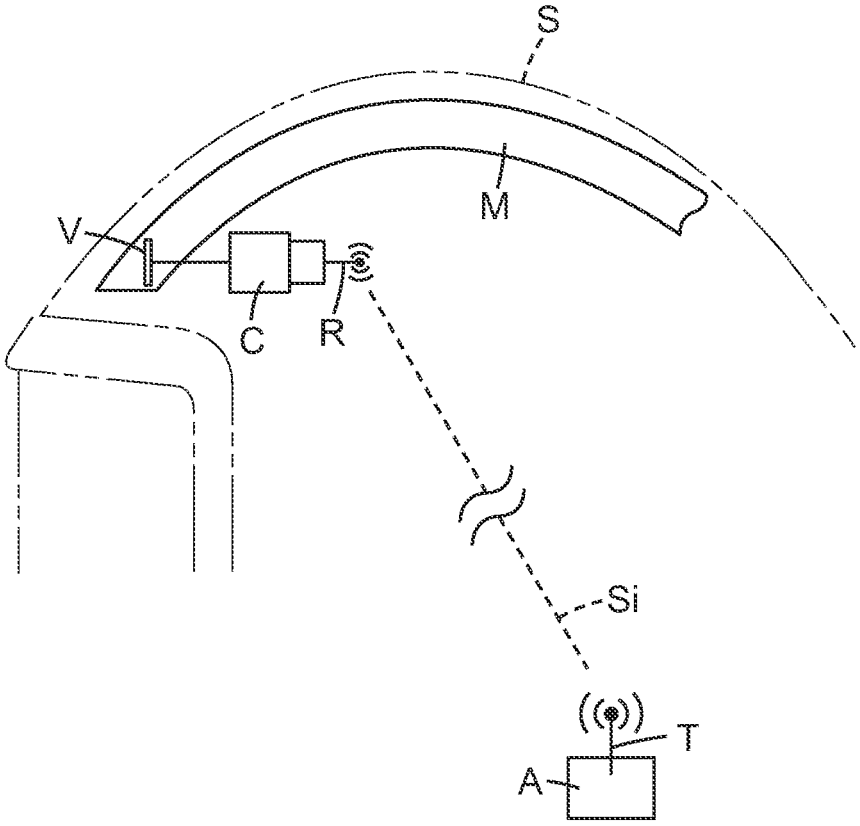
FIG. 9 is a schematic illustration of an alternative vane position control configuration.

In addition, while the controllers disclosed above are all mechanical in nature (e.g., vane position determined by manipulated paddles or knobs), other controllers for a vane are also contemplated, such as electromechanical. For instance, an electromechanical device may be used to control movement of the vane. Such an embodiment is illustrated in FIG. 9, wherein a shell S of a respirator assembly has a manifold M therein. In this exemplary embodiment, vane V and at least a portion of a controller C therefor reside within the shell S of the respirator assembly. The controller C (such as a servo motor) moves the vane V in response to a remote signal Si invoked by the user manipulating an actuator A outside of the shell S. The signal Si may be delivered either through cables, wired connections or radio "wireless communication." A wireless-controlled vane V in such an application would employ a radio receiver R for receiving control signals Si transmitted from a user-operated transmitter T associated with the actuator A. Thus, the controller C is within the shell S and causes movement of the vane V in response to the signal Si generated by the actuator A outside of the shell S. As discussed above, the vane may operate between two or more positions to control air flow direction exiting an air outlet, or may have a plurality of positions. The actuator A for the controller C may be conveniently located for user access and activation on the respirator assembly, or on a PAPR blower controller, or incorporated into a separate hand-held transmitter.

What is claimed is:

1. A respirator assembly comprising:

a protective shell shaped to cover at least a portion of a user's head and define a breathable air space, wherein the protective shell comprises a visor through which the user can see while the protective shell is worn by the user;

an air inlet conduit;

a top air delivery conduit in fluid communication with the air inlet conduit and having a top outlet at a terminal end of the top air delivery conduit, wherein the top outlet is configured to be adjacent a Forehead area of the user when the protective she is worn by the user, wherein the top air delivery conduit is configured to deliver air to the breathable air space defined within the protective shell;

a side air delivery conduit in fluid communication with the air inlet conduit and having an upper portion, a lower portion, and an elbow portion, wherein the lower portion of the side air delivery conduit defines a side outlet configured to deliver a flow of air into the breathable air space, wherein the elbow portion is flexible and allows movement of the lower portion relative to the upper portion to adjust the side outlet between a first outlet configuration wherein the air flow from the side outlet is directed in a first direction and a second outlet configuration wherein the air flow from the side outlet is directed in a second, different direction, and wherein the side outlet is moveable between its first and second outlet configurations while the protective shell is worn by the user; and a manipulatable element outside the protective shell, wherein the manipulatable element is configured to move the lower portion of the side air delivery conduit to move the side outlet between its first and second outlet configurations.

2. The respirator assembly of claim 1, and further comprising:

a belt-worn air supply; and a hose connecting the air supply to the air inlet conduit.

3. The respirator assembly of claim 1, wherein the side outlet is adjacent the visor of the protective shell.

4. The respirator assembly of claim 1, wherein the protective shell comprises a hood or a head cover.

5. The respirator assembly of claim 1, wherein the protective shell comprises a hard shell portion.

6. The respirator assembly of claim 1, wherein the top air delivery conduit is a single air delivery conduit.

7. The respirator assembly of claim 1, wherein the air inlet conduit is configured to be adjacent the back of the user's head.

8. The respirator assembly of claim 1, further comprising:

a top vane, pivotably mounted adjacent to the top outlet, such that pivoting the top vane controls the direction of air flow out of the top outlet; and a controller coupled to and extending from the top vane, wherein movement of the controller is configured to pivot the top vane between a first position and a second position while the protective shell is worn by the user.

* * * * *